United States Patent [19]

Tokui et al.

[11] Patent Number: 4,601,321

[45] Date of Patent: Jul. 22, 1986

[54] VERTICAL DIE CASTING DEVICE

[75] Inventors: Masaaki Tokui; Toshika Masaoka, both of Toyota, Japan

[73] Assignee: Toyota Kidosha Kogyo Kabushiki Kaisha, Tokyo, Japan

[21] Appl. No.: 748,718

[22] Filed: Jun. 26, 1985

Related U.S. Application Data

[63] Continuation of Ser. No. 609,513, May 10, 1984, abandoned, which is a continuation of Ser. No. 349,362, Feb. 16, 1982, abandoned.

[51] Int. Cl.[4] ..... B22D 17/32

[52] U.S. Cl. ..... 164/155; 164/313; 164/457

[58] Field of Search ..... 164/155, 312, 313, 314, 164/315, 457

[56] References Cited

U.S. PATENT DOCUMENTS 4,330,026 5/1982 Fink ..... 164/457

FOREIGN PATENT DOCUMENTS 0975528 10/1975 Canada ..... 164/312

2045659 11/1980 United Kingdom ..... 164/312

*Primary Examiner*—Nicholas P. Godici

*Assistant Examiner*—Richard K. Seidel

*Attorney, Agent, or Firm*—Browdy and Neimark

[57] ABSTRACT

In the vertical die casting device of this invention, the molten metal is poured from the gate into the sleeve with the cavity gate closed by the counter tip; and when filling the cavity with the molten metal, the plunger tip and the counter tip are lowered at the same speed so as not to pressurize the molten metal held between the tips to prevent the temperature reduction of molten metal so that when the counter tip opens the cavity gate with the plunger tip continuing to move down the molten metal can smoothly flow into the cavity.

3 Claims, 2 Drawing Figures

VERTICAL DIE CASTING DEVICE

This application is a continuation of application Ser. No. 609,513 filed May 10, 1984, now abandoned, which is a continuation of application Ser. No. 349,362 filed Feb. 16, 1982, now abandoned.

BACKGROUND OF THE INVENTION

This invention relates to a vertical die casting device which consists of a sleeve connecting the pouring gate and the cavity gate and of a plunger tip inserted in the upper portion of the sleeve for injecting molten metal under pressure and a counter tip inserted in the lower portion of the sleeve for guiding the molten metal into the cavity gate. More particularly this invention relates to a vertical die casting device in which the counter tip is made to retract at the same time and at the same speed as the plunger tip moves down so that the molten metal can be poured, without being pressurized, into the cavity.

In the conventional vertical die casting devices, as shown in FIG. 1, a plunger tip 4 and a counter tip 5 are disposed opposite to each other in the sleeve 3 that connects the pouring gate 1 and the cavity gate 2. When the counter tip 5 is at a position that closes the cavity gate 2, the molten metal 6 is poured from the gate 1 into the sleeve 3 and then the plunger tip 4 is forced down by a proper pressure application mechanism to apply pressure to the molten metal so as to push down the counter tip 5 via the pressurized molten metal and cause the molten metal to flow into the cavity through the cavity gate 2.

This construction, however, has disadvantages: that is, since the molten metal 6 in the sleeve 3 is pressurized between the plunger tip 4 and the counter tip 5, the resulting increase in adhesion between the molten metal 6 and the sleeve 3 or the tips 4, 5 allows more heat to be transferred to the sleeve and tips, resulting in reduction in the temperature of molten metal. This can prevent a smooth flowing of the molten metal into the vacity or reduce the life of the sleeve 3 and tips 4, 5.

SUMMARY OF THE INVENTION

The primary object of this invention is to provide a vertical die casting device which overcomes the above-mentioned drawbacks of the conventional die casting devices by leading the molten metal poured in the sleeve into the cavity without pressurizing the molten metal.

DESCRIPTION OF THE PREFERRED EMBODIMENT

Figure 1:
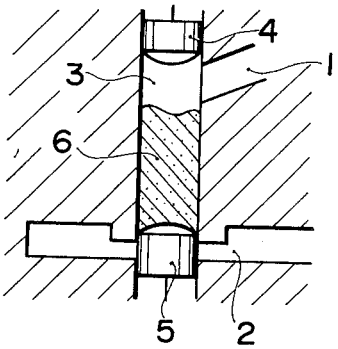
FIG.1 PRIOR ART
FIG. 1 is an explanatory drawing showing the conventional die casting technique.

Designated 7 is a vertical die casting device which has a cavity 10 formed between the upper die 8 and the lower die 9.

A sleeve 11 is vertically disposed with the lower portion communicating with the cavity 10 through the cavity gate 12 and with the upper portion having a slant pouring gate 13.

The sleeve 11 has an injection plunger tip 14 inserted in the upper portion thereof and a counter tip 15 in the lower portion in such a way that they face each other. The plunger tip 14 is connected through a rod 16 to a hydraulic cylinder 17 as a pressure applying mechanism, and the counter tip 15 is connected through the rod 18 to a hydraulic cylinder 19 as a retracting mechanism. The hydraulic cylinder 19 is equal in diameter to the other hydraulic cylinder 17.

The hydraulic cylinder 17 has a piston 20 connected with the rod 16 to form an upper chamber 21 and a lower chamber 22, both of these chambers being interconnected by an oil pipe 23 with a pump 24 and a solenoid changeover valve 25 provided on the pipe 23. The pump 24 and the solenoid changeover valve 25 are connected to a controller 26.

The other hydraulic cylinder 19 also has a piston 27 to form an upper chamber 28 and a lower chamber 29, both of which are interconnected by an oil pipe 30 with a pump 31 and a solenoid changeover valve 32 installed on the pipe 30. The solenoid changeover valve 32, the limit switch 33 activated by a device fitted to the rod 16, another limit switch 34 activated by a device fitted to the rod 18, and the pump 31 are all connected to the controller 26. The pump 31 and the solenoid changeover valve 32 are activated by the controller 26 when the plunger tip 14 reaches the lower edge of the pouring gate 13 and the upper surface of the counter tip 15 reaches the lower edge of the cavity gate 12.

The flow regulating valves 35, 36 provided in the oil pipes 23, 30 serve as speed controllers that cause the plunger tip 14 and the counter tip 15 to move down at the same speed, by controlling the oil flows entering the upper chambers 21 and 28 of the cylinders 17, 18 to be equal. Designated 37 is a molten metal.

The process of die casting using the vertical die casting device of the above construction will be explained with reference to FIG. 2. First, the solenoid changeover valve 25 is shifted to the b mode as shown and the other solenoid changeover valve 32 is energized to shift to the a mode to lift the plunger tip 14 and the counter tip 15. The pouring gate 13 is then opened and the cavity gate is closed by the side of the counter tip 15.

As the molten metal 37 is poured from the gate 13 into the sleeve 11, the molten metal 37 will stay in the sleeve 11 on the counter tip 15 as shown.

Next, when a command signal is given to the controller 26 to shift the solenoid valve 25 to the a mode and operate the pump 24, the pressurized oil is then delivered into the upper chamber 21 of the cylinder 17 causing the piston 20 and the plunger tip 14 to move down.

When the plunger tip 14 reaches the lower edge of the pouring gate 13, i.e., the upper surface of the molten metal 37, a signal from the limit switch 33 shifts the solenoid valve 32 to the b mode and operates the pump 31 to deliver the oil pressure to the upper chamber 28 of the cylinder 19 causing the piston 27 and the counter tip 15 to move down. The flow rates of pressurized oil entering the upper chambers of the cylinders 17, 19 are controlled by the flow regulating valves 35, 36 so that they are virtually equal. Since the diameters of the hydraulic cylinders 17, 19 are the same, the plunger tip 14 and the counter tip 15 move down at the same speed.

Therefore, when the plunger tip 14 and the counter tip 15 are moving downward, no pressure is applied to the molten metal 37 held between them, so that heat transfer from the molten metal 37 to the sleeve 11 or the tips 14, 15 cannot easily occur.

Now, when the upper surface of the counter tip 15 reaches the lower edge of the cavity gate 12, a signal from the limit switch 34 causes the pump 31 to stop as well as the counter tip movement.

As a result, the plunger tip 14 that continues moving down causes the molten metal 37 to flow into the cavity 10 through the cavity gate 12. At this time because the temperature decrease of the molten metal 37 is kept minimum as explained earlier, the molten metal can smoothly flow into the cavity.

With the above process completed, the upper die 8 and the lower die 9 are separated to take a product out of the cavity 10.

Figure 2:
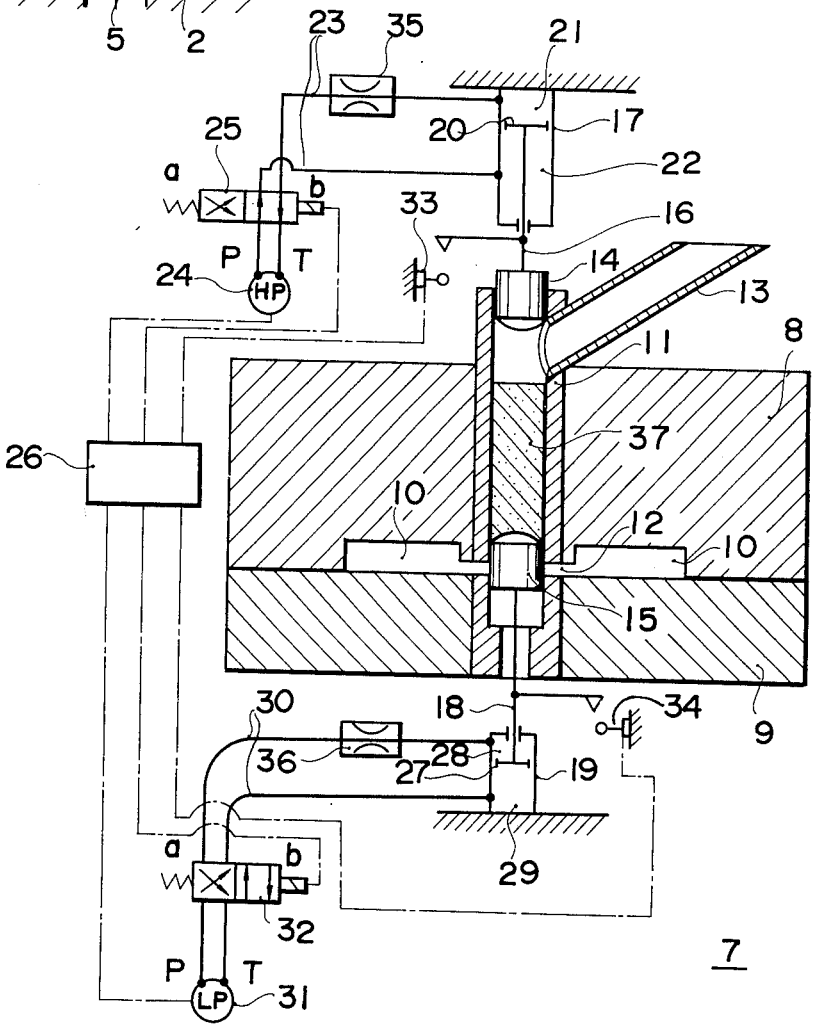
FIG. 2 is a cross section of the vertical die casting device embodying the present invention.

Then, the upper and lower dies are again clamped together; the solenoid changeover valve 25 is changed over to the b mode and the solenoid valve 32 to the a mode; and the pumps 24, 31 are operated to return the plunger tip 14 and the counter tip 15 to their upper positions, as shown in FIG. 2, to repeat the die casting process described above.

It should be noted that this invention is not limited to the above embodiment alone and various modifications are possible. For instance, the mechanism for lowering the plunger tip and counter tip may be replaced with the combination of motor and gear instead of the hydraulic cylinders.

As can be seen in the foregoing, since the pressure applying mechanism for the injection plunger tip and the mechanism for lowering the counter tip are activated in synchronism with each other, the molten metal is not pressurized in the sleeve by the opposing plunger tip and counter tip, so that the adhesion between the molten metal and the sleeve or tips is kept from increasing and the molten metal temperature is maintained, thus assuring the smooth flow of molten metal into the cavity and therefore a good cast product.

Furthermore, since the molten metal is not pressurized, it will not enter between the sleeve and the tips and this prevents the sticking of sleeve and tips and elongates their life.

We claim:

1. A vertical die casting device for charging molten metal into a mold cavity, comprising;

a pouring gate;

a cavity gate located below said pouring gate;

a sleeve connecting said pouring gate and said cavity gate;

an injection plunger tip inserted in the upper portion of said sleeve;

a counter tip inserted in the lower portion of said sleeve, said plunger tip and said counter tip being disposed opposite to each other; and means for preventing the application of pressure by said tips to the molten metal when the molten metal is charged into the mold cavity, including:

retracting means for causing said counter tip to move downwardly, continuously, from a first position in said sleeve at which access to said cavity gate by any molten metal in said sleeve is totally blocked to a second position in said sleeve at which access to said cavity gate by any molten metal in said sleeve is totally open, said retracting means comprising a first actuator;

activating means for causing said plunger tip to move downwardly, continuously, from a third position in said sleeve above said pouring gate to a fourth position in said sleeve adjacent said cavity gate, said activating means comprising a second actuator;

control means for causing said activating means to begin the downward motion of said plunger tip and for causing said retracting means to begin the downward motion of said counter tip when said plunger tip reaches a position approximating the expected upper level of molten metal in said sleeve when in use; and regulating means connected to said retracting means and activating means for causing said retracting means and said activating means to move said plunger tip and said counter tip at the same speed when both are in motion, said regulating means comprising equalization means for equalizing the rates of movement of said first and second actuators.

2. A vertical die casting device in accordance with claim 1, wherein said control means includes:

first sensing means for sensing when said plunger tip has moved downwardly to a position approximating the expected upper level of molten metal in said sleeve, and for causing the activation of said retracting means when said position is sensed;

second sensing means for sensing when said counter tip has moved downwardly to a position at which said cavity gate is fully open and for stopping said retracting means when said position is sensed.

3. A vertical die casting device in accordance with claim 1, wherein said first and second actuators comprise hydraulic cylinders, and said equalization means comprises flow regulating valve means for causing the rate of flow of hydraulic fluid into said hydraulic cylinders to be equalized.

* * * * *

UNITED STATES PATENT AND TRADEMARK OFFICE

CERTIFICATE OF CORRECTION

PATENT NO. : 4,601,321

DATED : July 22, 1986

INVENTOR(S) : Tokui et al

It is certified that error appears in the above-identified patent and that said Letters Patent is hereby corrected as shown below: Title page:

Correct the name of assignee to read:

--Toyota Jidosha Kogyo Kabushiki Kaisha,
Aichi-ken, Japan--

Signed and Sealed this

Thirteenth Day of January, 1987

*Attest:*

DONALD J. QUIGG

*Attesting Officer*

*Commissioner of Patents and Trademarks*